United States Patent [19]

Kaneko

[11] Patent Number: 5,052,384

[45] Date of Patent: Oct. 1, 1991

[54] BREATHING APPARATUS

[75] Inventor: Tsuneyo Kaneko, Tokyo, Japan

[73] Assignee: Lederle (Japan), Ltd., Tokyo, Japan; a part interest

[21] Appl. No.: 594,142

[22] Filed: Oct. 10, 1990

[30] Foreign Application Priority Data

Oct. 11, 1989 [JP] Japan ..... 1-264626
May 31, 1990 [JP] Japan ..... 2-142589

[51] Int. Cl.[5] ..... A62B 7/00

[52] U.S. Cl. ..... 128/205.14; 128/205.13; 128/205.17; 128/201.27

[58] Field of Search ..... 128/201.11, 201.27, 128/201.28, 205.13, 205.14, 205.17

[56] References Cited

U.S. PATENT DOCUMENTS 3,827,432 8/1974 Lundgren et al. ..... 128/205.17
4,273,120 6/1981 Oswell ..... 128/204.26
4,793,340 12/1988 Ottestad ..... 128/201.27
4,879,996 11/1989 Harwood, Jr. et al. ..... 128/205.17

*Primary Examiner*—Aaron J. Lewis
*Attorney, Agent, or Firm*—Wegner, Cantor, Mueller & Player

[57] ABSTRACT

A breathing apparatus has first bellows and second bellows, the first bellows being so designed as to expand by a part of air exhaled by the diver or wearer of the breathing apparatus being supplied thereto through a mouth piece and the second bellows being so designed as to contract as the pressure of a surrounding atmosphere around the breathing apparatus, i.e., the atmospheric pressure under water. When the sum of an expanded amount of the first bellows and a contracted amount of the second means reaches a value which is equal to or larger than a predetermined value, an exhalation discharge valve disposed on a mouth piece is so opened as to discharge the exhaled air into a surrounding atmosphere around the breathing apparatus. This arrangement for the breathing apparatus enables the number of times of re-utilizing the exhaled air as air for inhalation to increase as the pressure of the surrounding atmosphere increases.

20 Claims, 6 Drawing Sheets

BREATHING APPARATUS

BACKGROUND OF THE INVENTION

1. Field of the Invention

The present invention relates to a breathing apparatus and, more particularly, to a breathing apparatus which can function as a gas supply apparatus for inhaling gases suitable for use in an air-free atmosphere, particularly under water.

2. Description of Related Art

A breathing apparatus for providing gases of inhalation including oxygen under water to a diver is known generally as an aqua lung, and such aqua lungs are currently employed extensively by divers and so on. The breathing apparatus comprises at least a mouth piece connected to the mouth of the diver or the like and a fresh air reservoir tank connected to the mouth piece.

By inhalation of air by the diver, the fresh air stored in the fresh air reservoir tank is supplied to the diver through the mouth piece. On the other hand, exhalation of air by the diver allows the exhaled air to be discharged from the mouth piece into a surrounding atmosphere, namely, into water.

A general type of the breathing apparatus is so designed as capable of employing the fresh air supplied from the fresh air reservoir tank only once as an air of inhalation. Hence, in order to accommodate a comparatively large amount of air, the fresh air reservoir tank is designed to be of a considerably large size. Nevertheless, the period of time that allows the diver or wearer to stay or work under water is limited to a comparatively short period of time.

From this standpoint, there have been proposed a variety of breathing apparatuses of a type capable of circulating and re-employing air exhaled by the diver or other wearers as air of next inhalation. In other words, it is possible to re-use the exhaled air as air of next inhalation as long as a content of carbon dioxide gas contained in the exhaled air would not exceed a predetermined value. Many breathing apparatuses of an exhalation circulating type have an exhalation reservoir tank which temporarily stores the air exhaled by the diver or other wearer through the mouth piece, as disclosed in, for example, Japanese Patent Unexamined Publication (kokai) No. 38,397/1975. Some breathing apparatuses are so designed as to remove carbon dioxide gas in the exhaled air by an adsorbing agent or the like prior to utilizing it as air of next inhalation as disclosed in, for example, Japanese Patent Unexamined Publication (kokai) No. 38,397/1975 and Japanese Patent Examined Publication (kokoku) No. 24,034/1984. Further, Japanese Patent Examined Publication (kokoku) No. 45,158/1977 proposes reutilization of the air exhaled at an initial stage of exhalation alone as air of inhalation, with the fact taken into consideration that the content of carbon dioxide gas is smaller in the initial stage of exhalation than in the later stage of exhalation to be made by the diver or wearer.

It is to be understood that the exhaled air containing carbon dioxide gas in the amount of approximately 7.5% or lower can be reutilized as air of inhalation. It can be noted that the air exhaled after a single act of breathing using fresh air as air of inhalation under one atmospheric pressure contains approximately 5% of carbon dioxide gas and approximately 15% of oxygen. On the other hand, the amount of oxygen to be used per a breath remains approximately constant regardless of the atmospheric pressure of the surrounding atmosphere, namely, the depth under water. This means that the rate of carbon dioxide gas to be contained in the air exhaled by one breath is reduced to a smaller extent as the depth under water becomes deeper. More specifically, the rates of carbon dioxide gas containing in the air exhaled when the air has been exhaled by one breath using fresh air as air of inhalation are about 2.5% under two atmospheric pressure, about 1.67% under three atmospheric pressure, and about 1.25% under four atmospheric pressure.

As is to be readily understood from the foregoing description, the present invention has been completed under circumstances as described hereinabove and has the object to provide a breathing apparatus so designed as to increase the number of times of re-employing the exhaled air as the depth under water becomes deeper.

SUMMARY OF THE INVENTION

In order to achieve the above-mentioned object, the present invention consists of a breathing apparatus having having a fresh air supply circuit with a fresh air reservoir section in which fresh air is stored and an exhalation circulation circuit with an exhalation reservoir section in which exhaled air is stored, each of said fresh air supply circuit and said exhalation circulation circuit being connected to a mouth piece so as to be capable of re-employing the exhaled air as air for next inhalation, comprising:

an exhalation control valve for storing the exhaled air in said exhalation reservoir section by closing an exhalation outlet for discharging the exhaled air coming from the mouth piece into a surrounding circumstance;

a biasing means for biasing said exhalation control valve in a direction of closing said exhalation control valve;

a first contraction means so constructed by a flexible member as to be contractible and expandable, as to define an air control chamber inside the first contraction means, and as to expand by supplying a portion of the exhaled air from said mouth piece into the air control chamber;

a second contraction means so constructed by a flexible member as to be contractible and expandable and as to contain a predetermined amount of gas and as to contract as a pressure of said surrounding circumstance increases;

an addition means for producing the sum of an amount corresponding to expansion of said first contraction means and an amount corresponding to contraction of said second contraction means;

an association means for associating said addition means with said exhalation control valve so as to open said exhalation control valve in resistance to said biasing means when the sum produced by said addition means reaches a value which is equal to or larger than a predetermined value; and a pressure release valve for releasing a pressure within said air control chamber when the fresh air is supplied from said fresh air supply circuit to said mouth piece.

With this arrangement as described hereinabove, the breathing apparatus according to the present invention is so designed as capable of re-utilizing air exhaled by the diver or other wearer as it is as air for inhalation because the exhalation control valve is kept closed until the sum of the lengths of expansion of the first contraction means and contraction of the second contraction means reaches the predetermined value. And the exhalation control valve is allowed to be opened at thetime when the sum reaches the predetermined value, thereby causing the exhaled air to be discharged from the exhalation outlet into the surrounding circumstance and allowing fresh air to be inhaled when the diver or wearinhales air immediately after the latest exhalation.

Further, it is to be noted that, as the first contraction means is designed so as to be contracted to a greater extent as the depth under water becomes deeper, the first contraction means is required to be expanded to a greater extent in accordance with a deeper depth under water. This means that the number of times of re-utilizing the exhaled air can be increased as the depth under water becomes deeper.

A more preferred embodiment of the breathing apparatus according to the present invention is such that the addition means for adding the length of the expaned first contractions means to the length of the contracted second means is of a shape in which one contraction means is superposed on the other contraction means, namely, of a laminate structure, in a direction in which the two contraction means are contracted or expanded. This laminate structure enables the length of the two contraction means of such a laminate structure to be utilized as the sum. More specifically, when one end side of the laminate structure in the contracting or expanding direction is fixed to a given member, the position on the other end side of the laminate structure with respect to the given member indicates the sum which in turn can readily be given as a stroke position of an operating rod mounted to the other end of the laminate structure.

A preferred aspect of the present invention consists of a breathing apparatus having a fresh air supply circuit with a fresh air reservoir section in which fresh air is stored and an exhalation circulation circuit with an exhalation reservoir section in which exhaled air is stored, each of said fresh air supply circuit and said exhalation circulation circuit being connected to a mouth piece so as to be capable of re-employing the exhaled air as air for next inhalation, comprising:

a tubular main tube to which said mouth piece is mounted and to which said fresh air supply circuit and said exhalation circulation circuit are connected, and which is provided with an exhalation outlet for discharging the exhaled air into a surrounding circumstance;

an exhalation control valve for storing the exhaled air in said exhalation reservoir section by closing said exhalation outlet;

a biasing means for biasing said exhalation control valve in a direction of closing said exhalation control valve;

a first contraction means so constructed by a flexible member one end of which is fixed to said tubular main body as to be contractible and expandable, as to define an air control chamber inside the first contraction means, and as to expand by supplying a portion of the exhaled air from said mouth piece into the air control chamber;

a second contraction means so constructed by a flexible member one end of which is fixed to another end of said first contraction means as to be contractible and expandable and as to contain a predetermined amount of gas and as to contract as a pressure of said surrounding circumstance increases;

an operating rod so disposed as to be connected to another end of said second contraction means and as to be stroke-displaced in accordance with contraction or expansion of at least either one of said first contraction means or said second contraction means;

a link mechanism so disposed as to operatively associate said operating rod with said exhalation control valve so as to open said exhalation control valve in resistance to said biasing means when said operating rod is displaced in a predetermined direction in an amount which is equal to or larger than a predetermined value;

a diaphragm so disposed as to displace by a difference between a pressure within said tubular main body and a pressure of said surrounding circumstance;

an inhalation control valve so disposed as to be operatively associated with said diaphragm so as to control fresh air to said tubular main body from said fresh air supply circuit; and a pressure release valve so disposed as to be operatively associated with said diaphragm, namely, eventually said inhalation control valve, so as to release the pressure within said air control chamber into said tubular main body when said inhalation control valve is opened.

The breathing apparatus according to the present invention is extremely useful to decrease an amount of consumption of fresh air while increasing the number of times of re-utilizing the exhaled air as air for inhalation as the depth under water becomes deeper.

Furthermore, the breathing apparatus according to the present invention is also preferred from a standpoint of ensuring a secure operation under water because all operations are mechanically implemented.

Other objects, features and advantages of the present invention will become apparent in the course of the description of the preferred embodiments, which follows, when taken in conjunction with the accompanying drawings.

BRIEF DESCRIPTION OF THE DRAWINGS

FIGS. 1 to 3 are directed to a first embodiment of the breathing apparatus according to the present invention, in which:

FIG. 1 is a view showing an outline of the breating apparatus according to the first embodiment of the present invention;

FIG. 2 is a partially sectional view showing en essential portion of the breathing apparatus; and FIG. 3 is an enlarged front view showing the positional relationship between a long hole 64*a* and a pin portion 43*a* immediately before the first act of inhalation under one atmosphereic pressure.

FIGS. 4 to 7 are directed to a second embodiment of the breathing apparatus according to the present invention, in which:

FIG. 4 is a view showing an outline of the breathing apparatus acording to the second embodiment of the present invention;

FIG. 5 is a sectional view, when taken along line X5—X5 of FIG. 4;

FIG. 6 is a partially sectional view showing the essential portion of the breathing apparatus; and FIG. 7 is an enlarged front view showing the positional relationship between the engagment lever and the engaging claws immediately before the first act of inhalation under one atmospheric pressure.

DETAILED DESCRIPTION OF THE PREFERRED EMBODIMENTS

The present invention will be described more in detail with reference to the accompanying drawings.

Figure 1:
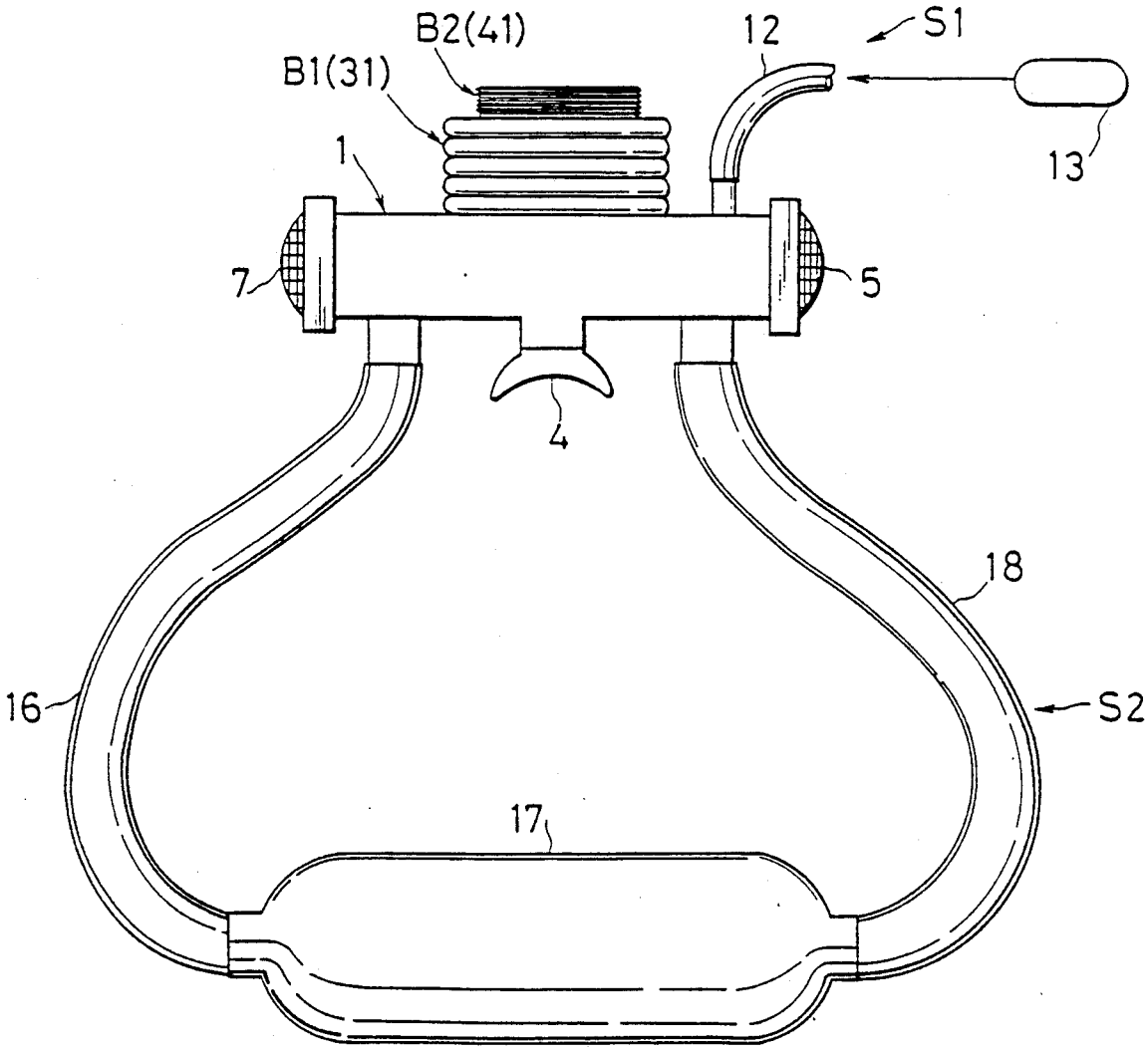
Figure 2:
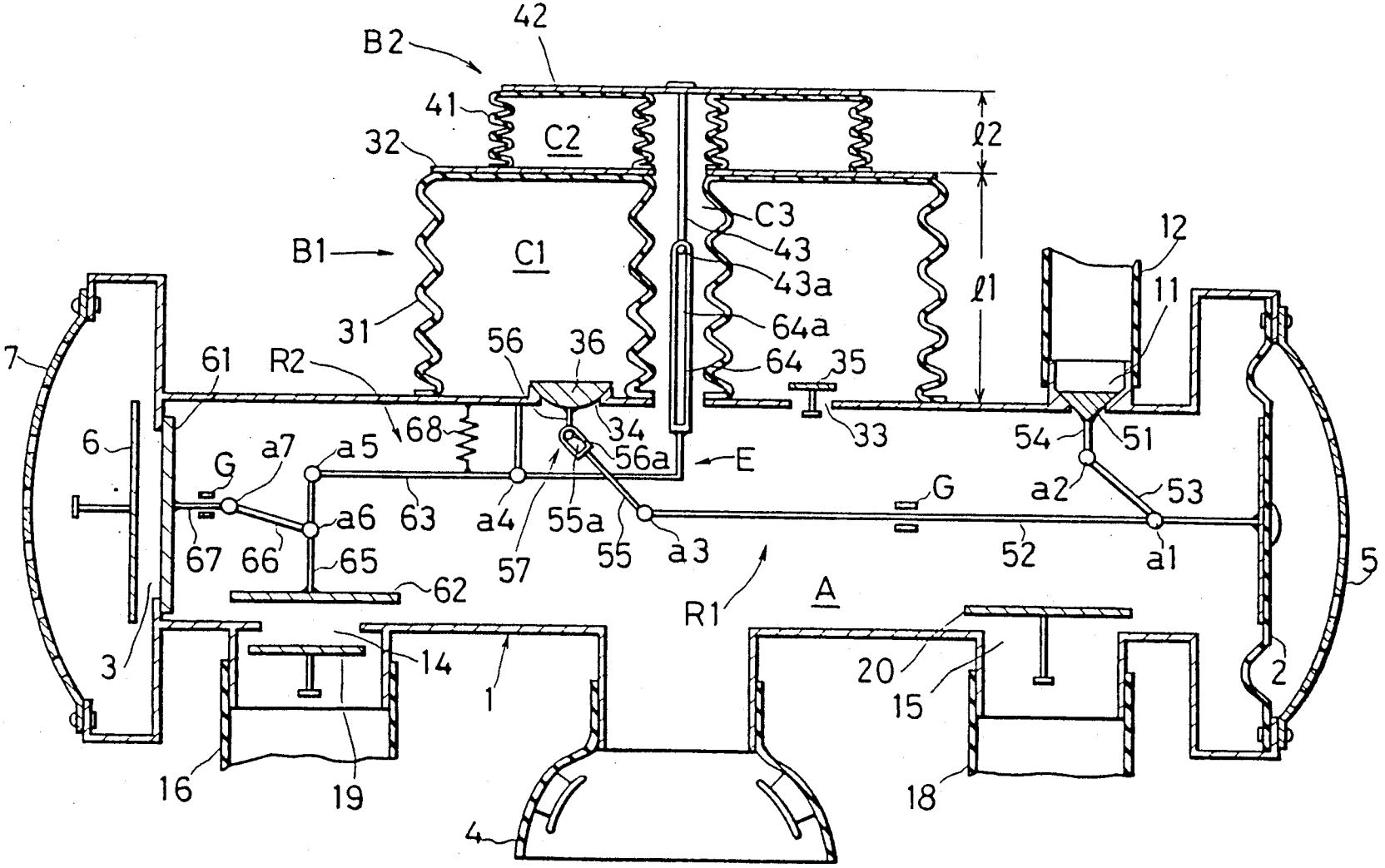
Figure 3:
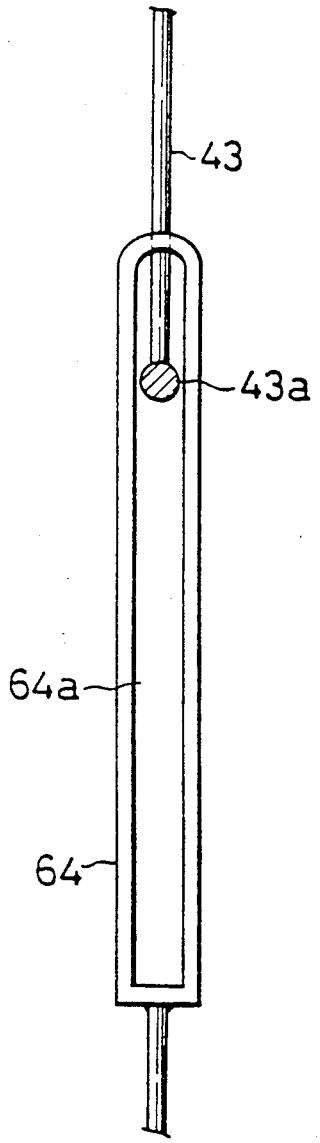

FIGS. 1 to 3 are directed to a first embodiment of the breathing apparatus according to the present invention.

As shown in FIGS. 1 and 2, reference numeral 1 denotes a tubular main body extending horizontally in the drawings, one opening end (the right end in the drawings) of which is closed by a diaphragm 2 and the other opening end (the left end in the drawings) of which serves as an exhalation outlet 3. At an approximate middle portion in the longitudinal direction of the tubular main body 1 is mounted a mouth piece 4 so as to be connected to and held in the mouth of a diver or a wearer of the breathing apparatus. The diver and wearer can breathe air or the like in and out, namely, inhale or exhale air or the like, through the mouth piece 4 and a breathing path A to be disposed within the tubular main body 1.

Outside the diaphragm 3 is disposed a protective net 5 fitted to the tubular main body 1 so as to prevent foreign materials present in an ambient atmosphere, or in the water, from entering into the tubular main body 1 and to adapt the pressure in accordance with the depth under water. On the other hand, the exhalation outlet 3 at the other opening end of the tubular main body 1 is provided with an exhalation valve 6 consisting of a check valve so as to allow a flow of exhaled air into the water outside the tubular main body 1. Outside the exhalation valve 6 is disposed a protective net 7 fitted to the tubular main body 1.

At an upper portion on the right-hand side of the tubular main body 1 is formed a fresh air inlet 11 for allowing inflow of fresh air. The fresh air inlet 11 is communicated with a fresh air reservoir tank 13 through a flexible piping 12. The fresh air reservoir tank 13 may be carried on a back of the diver or wearer (in FIG. 1, the tank is depicted in a substantially reduced size). As a matter of course, the fresh air reservoir tank 13 is filled with fresh air for inhalation (generally, pressurized air), and a path extending from the fresh air reservoir tank 13 to the tubular main body 1 constitutes a fresh air supply circuit S1 (FIGS. 1 and 4) to which in turn are connected per se known devices such as pressure regulating valve and so on.

Figure 4:
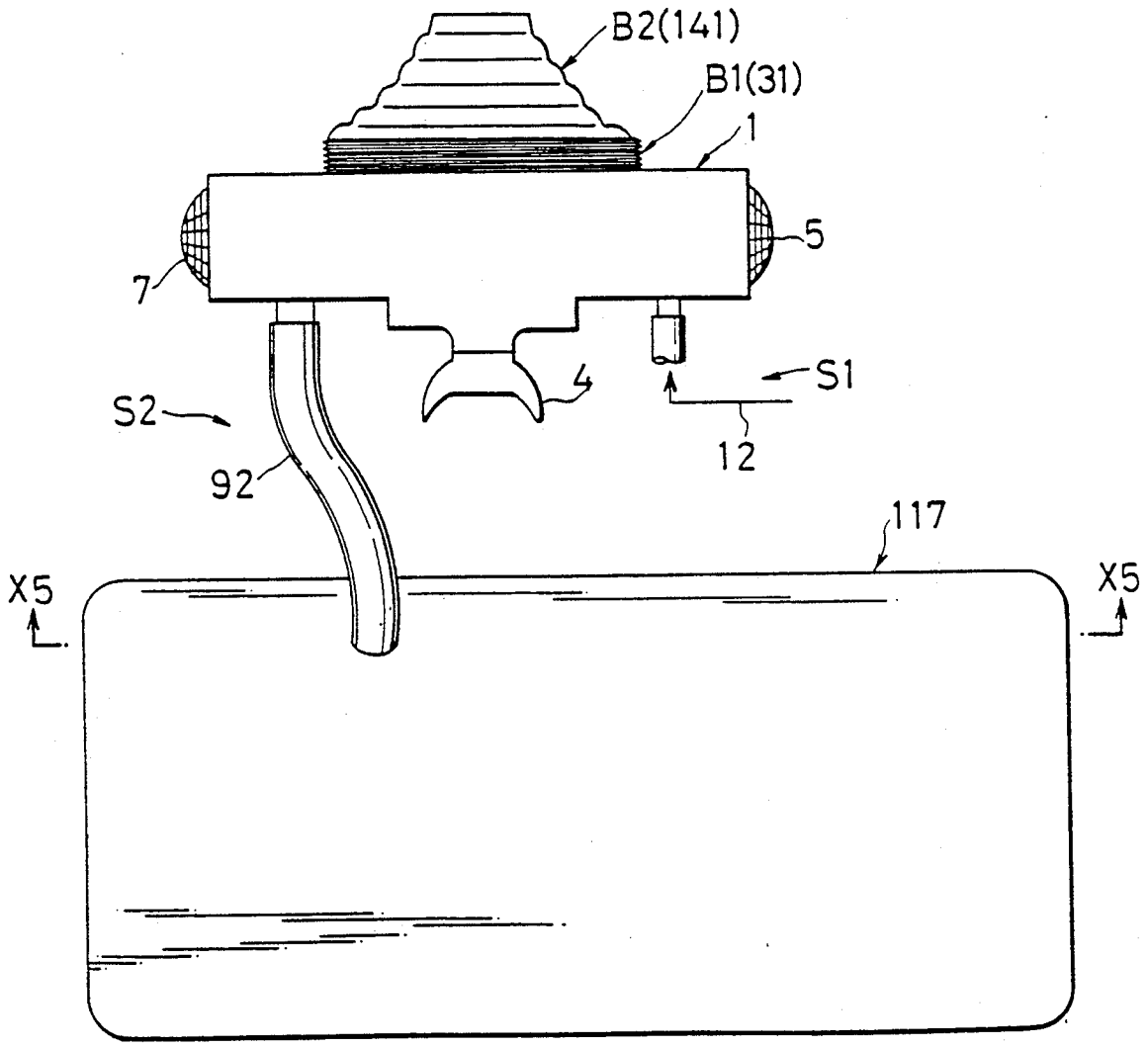
Figure 5:
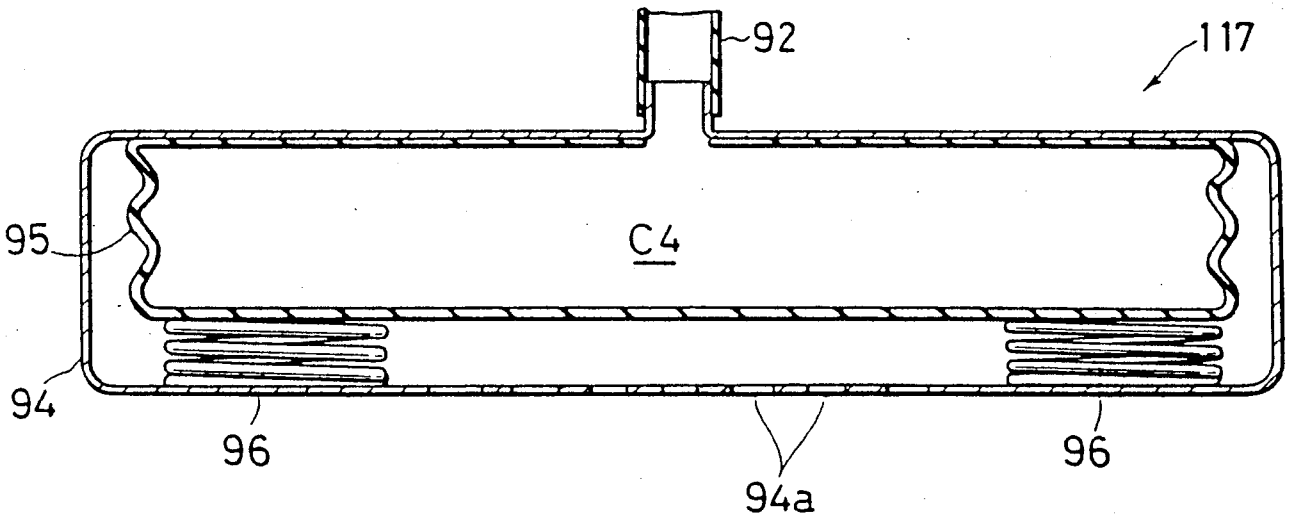

At a left end portion of the tubular main body 1 is formed an exhalation inlet 14 which is communicated with an exhalation reservoir tank 17 through a flexible piping 16. On the other hand, an exhalation outlet 15 is formed at a right end portion of the tubular main body 1, and the exhalation outlet 15 is communicated with the exhalation reservoir tank 17 through a flexible piping 18. At the exhalation inlet 14 is disposed a check valve 19 so as to allow only an inflow of exhaled air into the exhalation reservoir tank 17 from the tubular main body 1, while a check valve 20 is mounted at the exhalation outlet 15 so as to allow only an outflow of exhaled air into the tubular main body 1 from the exhalation reservoir tank 17. The check valve 20 is so disposed as to open even by reduction in a pressure within the tubular main body 1 to such an extent to which the diaphragm 2 does not displace. A path extending from the exhalation inlet 14 through the exhalation reservoir tank 17 to the exhalation outlet 15 constitutes an exhalation circulation circuit S2 (FIGS. 2 and 4). The capacity of the exhalation reservoir tank 17 is so arranged as to become substantially smaller than that of the fresh air reservoir tank 13.

On an upper wall of the tubular main body 1 is mounted a first contraction means B1 which comprises ring-sectioned bellows 31 and an annular retainer plate 32 fixed on an upper end of the ring-sectioned bellows 31. The ring-sectioned bellows 31 is fixed at its lower end portion to the upper wall of the tubular main body 1 so as to be contractible in a vertical direction in FIG. 2. The first contraction means B1 defines an air control chamber C1 within its inside. The air control chamber C1 is so arranged as to be communicated with the tubular main body 1 through an air inlet 33 for flowing air into the air control chamber C1 from the tubular main body 1 and an air outlet 34 for flowing air out from the air control chamber C1 into the tubular main body 1. The air inlet 33 is so provided with a check valve 35 as to allow only the inflow of air into the air control chamber C1 from the tubular main body 1, while the air outlet 34 is so provided with a pressure release valve 36 as to release the pressure within the air control chamber C1 in a manner as will be described hereinafter.

On the upper portion of the first contraction means B1 is disposed a second contraction means B2 which in turn comprises ring-sectioned bellows 41 and a flat plate 42 fitted on an upper end of the ring-sectioned bellows 41. The lower end portion of the ring-sectioned bellows 41 is fixed to the annular retainer plate 32 of the first contraction means B1 so as to be contractible in a vertical direction as shown in FIG. 2, like the ring-sectioned bellows 31. The ring-sectioned bellows 41 of the second contraction means B2 defines an annular space C2 within its inside, and the annular space C2 is filled with a predetermined amount of gas, such as air, under a predetermined pressure. To the flat plate 42 is fixed an operating rod 43 extending downwards through a circularly hollow space C3 concentrically and continuously defined by and passing through the first contraction means B1, the annular retainer plate 32, and the second contraction means B2.

The first contraction means B1 is so designed as to allow its expanding amount to become larger, i.e., a height or length of the ring-sectioned bellows 31 of the first contraction means B1 between the annular retainer plate 32 and the upper wall of the tubular main body 1 to become higher or longer, as the exhaled air is fed to the air control chamber C1 through the air inlet 33 from the tubular main body 1. In other words, as an amount of the air within the first contraction means B1 becomes larger, the length of the air control chamber C1 of the first contraction means B1 as indicated by symbol l1 in the drawings becomes longer. The second contraction means B2, on the other hand, is so designed as to allow its contracting amount to become smaller, i.e., to allow the flat plate 42 to come closer to the annular retainer plate 32 of the first contraction means B1, as a depth under water gets deeper. In the drawings, the length between the flat plate 42 and the retainer plate 32 is indicated by symbol l2. Hence, the sum of l1 and l2 (l1+l2) represents a total of the length of the first contraction means B1 and the length of the second contraction means B2, namely, the length between the flat plate 42 and the upper wall of the tubular main body 1, i.e., the addition of the expanded and contracted amounts of the first and second contraction means B1 and B2, respectively.

At the fresh air inlet 11 is disposed an inhalation control valve 51 which in turn is so designed as to be mechanically connected to the pressure release valve 36 through a link mechanism 51 which in turn serves as associating the inhalation control valve 51 and the pressure release valve 36 with the diaphragm 2. The link mechanism R1 has a link 52 supported by the tubular main body 1 so as to be movable in the longitudinal direction of the tubular main body 1, and one end of the link 52 is fixed to the diaphragm 2. The link 52 is connected to the inhalation control valve 51 through links 53 and 54. On the diaphragm side of the link 52, the link 52 is pivotably connected to the link 53 at a point as indicated by symbol a1, and the link 53 is so arranged as to be pivotably connected to the link 54 at a point as indicated by symbol a2. The other end of the link 54 is then connected to the inhalation control valve 51 disposed at the fresh air inlet 11 of the tubular main body 1. On the side of the link 52 opposite to the diaphragm 2, the link 52 is connected to the pressure release valve 36 through links 55 and 56. The link 52 is pivotably connected to the link 55 at an edge portion of the link 52, as indicated by symbol a3, while the link 55 in turn is pivotably connected to the link 56 through a delay mechanism 57. The link 56 is then connected to the pressure release valve 36. The delay mechanism 57 comprises a long hole 55*a* formed at an edge portion of the link 55 and a pin portion 56*a* so formed at an edge portion of the link 56 as to be slidably engaged with the long hole 55*a*. In FIG. 1, reference symbol G denotes a guide for the link, which is disposed within the tubular main body 1.

While the diaphragm 2 is located in the position as indicated in FIG. 1 by the link mechanism R1, the inhalation control valve 51 and the pressure release valve 36 are both closed. When the diaphragm 2 is displaced to the left in the drawing, the inhalation control valve 51 is first opened and the pressure release valve 36 is then delayed being opened to some extent by the action of the delay mechanism 57.

On the exhalation outlet 3 is disposed a discharge control valve 61, while a switch valve 62 is disposed on the exhalation inlet 14 so as capable of closing or opening the exhalation inlet 14. These valves 61 and 62 are both associated with the operating rod 43 through a link mechanism R2. The link mechanism R2 constitutes an association mechanism E operatively disposed in association with the operating rod 43 and comprises a link 63 held by the tubular main body 1 at a fulcrum a4 so as to be slidable. To an end portion of the link 63 is fixed a link 64 so disposed as to extend within and through the circularly hollow space C3. The link 64 has a long hole 64*a* so formed as to extend in the vertical direction in the drawing and as to be located within the circularly hollow space C3 defined by the respective first and second contraction means B1 and B2. The long hole 64*a* is so disposed as to be slidably engaged with a pin portion 43*a* formed at a lower end portion of the operating rod 43 (refer to FIG. 3, too). To the other portion of the link 63 is connected the switch valve 62 through a link 65 so as to be pivotable at a point as indicated by symbol a5. The link 65 is further connected to the exhalation outlet 61 through a link 66 connected pivotably to the link 65 at a point, as indicated by symbol a6, and then through a link 67 connected pivotably to the link 66 at a point, as indicated by symbol a7. The link 63 is supported by a spring 68 so as to be biased in the clockwise direction in FIG. 2 about the fulcrum a4.

The link mechanism R2 having the construction as described hereinabove is so biased by the spring 68 as a biasing means as to close the exhalation control valve 61 and open the switch valve 62, as shown in FIG. 2. On the other hand, when the link 63 is pivoted in the counterclockwise direction in resistance to the biasing force of the spring 68, the exhalation control valve 61 is opened while the switch valve 62 is closed.

The pivotal movement of the link 63 is carried out by operation of the operating rod 43. More specifically, when the first contraction means B1 is further expanded (the length l1 is increased) and, as a result, the pin portion 63*a* formed on the operating rod 43 is further displaced upwardly in such a state in which the pin portion 63*a* is located at the upper end of the long hole 64*a* formed on the link 64, namely, in which the pin portion 63*a* is abutted with the upper end of the long hole 64, on the one hand, the link 63 is caused to be pivoted in the counterclockwise direction about the fulcrum a4, thereby closing the exhalation control valve 61 while opening the switch valve 62. On the other hand, when the pin portion 43*a* of the operating rod 43 does not act upon the link 64 in a way to displace the link 64 upwardly, the link 63 is held by the spring 68 in such a state as shown in FIG. 2 in which the exhalation control valve 61 is closed and the switch valve 62 is opened. It is noted that, when the sum of the length l1 and l2 becomes higher than a predetermined value, the link 64 is raised upwardly by the operating rod 43.

Description will be made of the action of the breathing apparatus according to the present invention having the construction as described hereinabove.

The action of the breathing apparatus according to the present invention will first be described, given the diver wearing the breathing apparatus under water at one atmospheric pressure. When the diver does not breathe under one atmospheric pressure, the air control chamber C1 is not filled with the air sent out by the diver so that the first contraction means B1 is in such an initial state that its length l1 is adequately low and that the length l2 is as low as corresponding to one atmospheric pressure. At this time, the pin portion 43*a* of the operating rod 43 is located in a position below the uppermost end of the long hole 64*a* of the link 64 by a predetermined value, as shown in FIG. 3, thereby closing the exhalation control valve 61 while opening the switch valve 62. As the diver breathes air in for the first time in this state, the pressure within the tubular main body 1 is reduced so that the diaphragm 3 is caused to be displaced to the left in the drawing to thereby open the inhalation control valve 51 and, as a result, allowing fresh air to enter from the fresh air reservoir tank 13 into the tubular main body 1.

Then, the diver breathes air out for the first time. At this time, as the exhalation control valve 61 is closed, a majority of the air exhaled is supplied to the exhalation reservoir tank 17 through the exhalation inlet 14, while a portion of the air sent out by the diver forces the check valve 33 to open and it is supplied into the air control chamber C1. The supply of the exhaled air to the air control chamber C1 causes the first contraction means B1 to expand and to increase the length l1 of the air control chamber C1. After the first contraction means B1 was expanded by the exhalation of air for the first time, the length l1 of the first contraction means B1 is as high as corresponding to the position in which the pin portion 43*a* of the operating rod 43 is located in the vicinity of the upper end of the long hole 64*a* of the link 64.

Thereafter, when the diver breathes air in for the second time, the exhaled air stored in the exhalation reservior tank 17 forces the check valve 20 to open, thereby feeding the exhaled air into the tubular main body 1 and, as a result, suppressing the reduction in the pressure within the tubular main body 1. This allows the exhaled air stored in the exhalation reservoir tank 17 to be supplied to the diver as air to be inhaled for the second time, without displacement of the diaphragm 2 to the left, namely, without supplying fresh air stored in the fresh air reservoir tank 13 to the tubular main body 1.

When the diver breathed air out for the second time, a portion of the exhaled air is supplied to the air control chamber C1 to thereby increase the length l1 to a further extent. In a state prior to increasing the length l1 further, the pin portion 43*a* of the operating rod 43 is located in a position nearby the upper end of the long hole 64*a* of the link 64 so that the pin portion 43*a* is pulled up in an initial stage of breathing out air for the second time, thereby opening the exhalation control valve 61 and closing the switch valve 62. Therefore, as the air was breathed out for the second time, the exhaled air was discharged into the water through the exhalation outlet 3. It is noted herein that the exhalation valve 6 prevents water from flowing back into the tubular main body 1.

Then, when the diver inhales air for the third time, the pressure within the tubular main body 1 is reduced to a large extent and the diaphragm 2 is caused to be displaced to the left, i.e., inside the tubular main body 1, thereby opening the inhalation control valve 51 and consequently supplying fresh air from the fresh air reservoir tank 13 into the tubular main body 1. As some time has elapsed after the inhalation control valve 51 was opened, the pressure release valve 36 was opened to thereby release the pressure within the air control chamber C1 and returning the length l1 of the first contraction means B1 to its initial state. Thereafter, this series of the breathing operations are repeated.

It is to be noted herein that a delay of opening the pressure release valve 36 after the opening of the inhalation control valve 51 is effective for a supply of an adequate amount of fresh air within the tubular main body 1 and this can serve as preventing the inhalation of the exhaled air released from the air control chamber C1 by the diver. It is further to be noted that, under one atmospheric pressure, the air exhaled can be utilized again only once.

When the pressure under water is two atmospheric pressure, the length l2 of the second contraction means B2 is as half as the length l2 thereof under one atmospheric pressure. As the sum of the lengths l1 and l2 (l1+l2) necessary for opening the exhalation control valve 61 is as long as that under one atmospheric pressure, the length l1 of the first contraction means B1 should become longer than that under one atmospheric pressure by the length corresponding to the magnitude of reduction of the length l2 of the second contraction means B2, in order to open the exhalation control valve 61. It is to be noted that, under two atmospheric pressure, the number of times of reutilization of the exhaled air is two. In this case, the breathing operations under one atmospheric pressure as described hereinabove as one cycle are repeated twice and two series of the breathing operations may be considered as one cycle of the breathing operations under two atmospheric pressure. As the atmospheric pressure increases, namely, the depth under water becomes deeper, the length l2 of the second contraction means B2 becomes so smaller as to correspond to an increase in the atmospheric pressure and the number of times at which the exhaled air is utilized again in order to increase the sum of the lengths l1 and l2 by compensating for the distance in which the length l2 of the second contraction means B2 is shortened.

If the amount of air exhaled is smaller than the amount of the inhaled air required when the exhaled air is utilized again, the exhaled air stored in the exhalation reservoir tank 17 is supplied to the diver, thereby reducing the pressure within the tubular main body 1 to a great extent and opening the inhalation control valve 51 to thereby allow fresh air to be fed to the tubular main body 1 by the amount of air in which the tubular main body 1 is lacking. In this case, if the air is lacking too much, on the one hand, the pressure release valve 36 is opened and the first contraction means B1 is returned to its initial state. If the air is lacking to a slightly small extent, on the other hand, that is, to such an extent that allows the pin portion 56*a* of the delay mechanism 57 to displace within the range defined by the long hole 55*a* formed on the link 55, the pressure release valve 36 is kept closed and the length l1 of the first contraction means B1 does not vary.

FIGS. 4 to 7, inclusive, are directed to a second embodiment of the breathing apparatus according to the present invention, in which elements identical to or similar to those in the first embodiment are provided with the same reference numerals and symbols as those in the first embodiment, and duplicate description on these elements is omitted herefrom for brevity of explanation. Hence, the following is description of portions of the second embodiment which substantially differs from the first embodiment.

In the second embodiment, bellows 141 (corresponding to the ring-sectioned bellows 41 in the first embodiment) structuring the second contraction means B2 is so designed as to have its side wall to become of an approximately logarithmic-curved shape, thereby enabling the number of actual circulations of the exhaled air in accordance with the depth under water to completely or substantially agree with the number of theoretically available circulations of the exhaled air. More specifically, for the breathing apparatus according to the first embodiment of the present invention, given the setting of the length l2 of the second contraction means B2 to an initial value L under one atmospheric pressure, the length l2 thereof under two atmospheric pressures is represented by L/2, i.e., a half of the length l2 thereof under one atmospheric pressure. Under three atmospheric pressures, the length l2 of the second contraction means B2 is L/3, i.e., one third of the length l2 thereof under one atmospheric pressure, while under four atmospheric pressures, the length l2 thereof becomes one fourth, i.e., L/4, of the length l2 thereof under one atmospheric pressure. It is to be noted herein that, as the pressure under sea increases, the length l2 of the second contraction means B2 is shortened at the same rate as described hereinabove. This means that, in the first embodiment, for example, the number of circulations of the exhaled air is one under one atmospheric pressure, two under two atmospheric pressures, three under three atmospheric pressures, and four under four atmospheric pressures, while the number of theoretically available circulations of the exhaled air is three under two atmospheric pressure, four under three atmospheric pressures, six under four atmospheric pressures, and so on. As is apparent from the foregoing description, the number of actual circulations of the exhaled air for the breathing apparatus according to the first embodiment of the present invention becomes smaller than the number of theoretically available circulations of the exhaled air. The breathing apparatus according to the second embodiment of the present invention, however, can allow the number of actual circulations of the exhaled air, in such a manner as will be described hereinafter.

Figure 6:
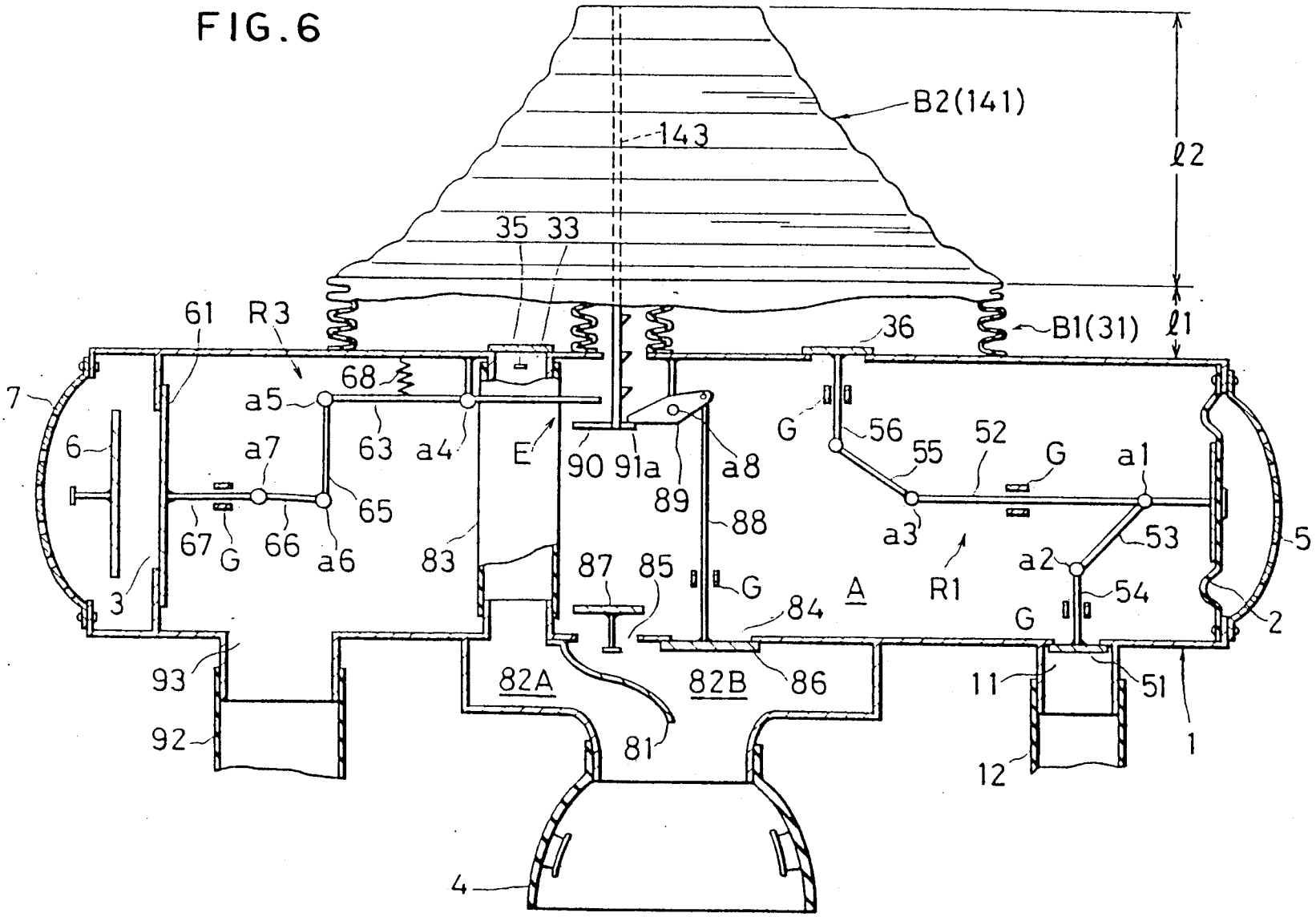

As shown in FIG. 6, for the breathing apparatus according to the second embodiment of the present invention, a path of respiration in the vicinity of the mouth piece 4 is divided into two path sections 82A and 82B, the path section 82A being communicated with the exhalation inlet 33 for the air control chamber C1 through a piping 83 and the path section 82B being communicated with the tubular main body 1 through an inhalation inlet 84 and an exhalation outlet 85. The inhalation inlet 84 is provided with an inhalation valve 86 as a reciprocating valve, while the exhalation valve 85 is provided with a check valve 87 which is so designed as to allow only an inflow of the exhaled air into the tubular main body 1 from the mouth piece 4.

The inhalation valve 86 as the reciprocating valve is connected through a link 88 to a one end portion of an engagement lever 89 which in turn is supported by the tubular main body 1 so as to be pivotable about a fulcrum a8. An operating rod 143 (corresponding to the operating rod 43 in the first embodiment) is so disposed as to extend through the tubular main body 1, i.e., in a vertical direction in the drawing. The disposition of the operating rod 143 in the manner as described immediately hereinabove fails to require for the link 64 as disposed in the first embodiment. The operating rod 143 has an operating piece 90 fixed to its lower end, on the one hand, and it is provided with a plurality of, for example, engaging claws 91*a* to 91*g*, inclusive, on the other hand, which are so formed on the operating rod 143 as to be spaced at substantially equal intervals, as shown specifically in FIG. 7. The operating piece 90 fixed to the operating rod 143 is so disposed as to act upon and be associated with the link 63 of a link mechanism R3 (corresponding to the link mechanism R2 of the first embodiment), while the engaging claws 91*a* to 91*b*, inclusive, disposed on the operating rod 143 function as ratchet teeth each of which in turn is so arranged as to be engaged with the other edge portion of the engagement lever 89 functioning as a ratchet claw, as will be described more in detail.

Further, it is noted that an exhalation reservoir tank 117 (corresponding to the exhalation reservoir tank 17 in the first embodiment) is communicated with the tubular main body 1 through only a piping 92 and an opening 93 formed on the tubular main body 1. The exhalation reservoir tank 117 in this embodiment comprises a first casing 94 having opening or openings 94*a* formed on its bottom and a second casing 95 made of a flexible member and so disposed within the first casing 94 as to define an exhalation reservoir chamber C4 and as to be contractible by the action of a spring 96 supported between the bottom surface of the second casing 95 and the inner bottom surface of the first casing 94. The spring 96 has a so small spring force as contracting the exhalation reservoir tank C4.

Description will now be made on the action of the breathing apparatus having the construction as described hereinabove according to the second embodiment of the present invention.

Figure 7:
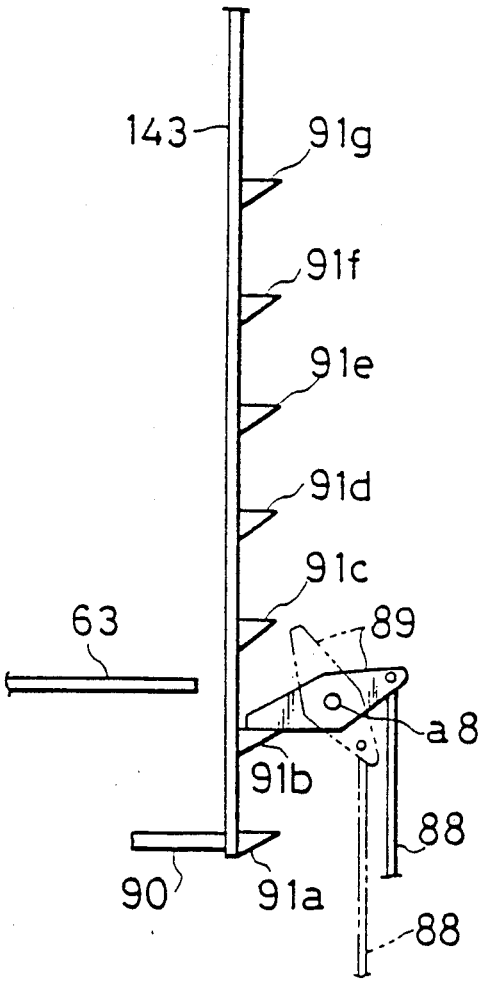

Prior to the diver's first act of inhalation in a state in which the surrounding circumstance is under one atmospheric pressure, the length l1, indicative of an amount of contraction or expansion of the first contraction means B1, is in a minimum and initial state, while the length l2, indicative of an amount of contraction or expansion of the second contraction means B2, is a maximum value. In this state, the operating rod 143 is located in such a position as illustrated in FIG. 7, in which the engagement lever 89 is engaged with the engaging claw 91*b*, as indicated by the solid line in FIG. 7. When the diver inhales air for the first time in this state, the pressure within the tubular main body 1 is so reduced as to displace the diaphragm 2 to the left in the drawing, i.e., inside the tubular main body 2, thereby opening the inhalation control valve 51. This operation allows fresh air to be supplied to the tubular main body 1 from the fresh air reservoir tank 13 and to open the inhalation valve 86 for allowing the fresh air to be employed as air for inhalation. The opening of the inhalation valve 86 allows the engagement lever 89 to be pivoted in the clockwise direction as indicated by the broken line in FIG. 7 and consequently to be disengaged from the second engaging claw 91*b*.

Then, when the diver exhales the air for the first time, a majority of the air exhaled passes through the path section 82B and forces the check valve 87 to open, thereby flowing into the tubular main body 1. As the exhalation control valve 61 is closed at this time, the air exhaled into the tubular main body 1 is allowed to be stored in the exhalation reservoir tank 117. On the other hand, a portion of the air exhaled passes through the path section 82A and forces the check valve 35 to open so as to flow into the air control chamber C1, thereby expanding the air control chamber C1, eventually the first contraction means B1 and raising the position of the operating piece 90 mounted on the bottom end of the operating rod 143 to a higher position. And the inhalation valve 86 is closed by the exhaled air passing through the path section 82B and the engagement lever 89 is pivoted in the counterclockwise direction and is caused to be engaged with the first engaging claw 91*a*, as in a state shown in FIG. 6). In this case, the pressure of exhalation of air acts as a force for pivoting the engagement lever 89 in the counterclockwise direction through the inhalation valve 86, thereby suppressing the engaging lever 89 from going over the first engaging claw 91*a*. In the manner as described hereinabove, an amount of expansion of the first contraction means B1 per one single act of breathing is set so as to correspond to a distance between the first engaging claw 91*a* and the second engaging claw 91*b*. The elevation of the inhalation valve 86 to a degree that exceeds a predetermined value, namely, the pivotal movement of the engagement lever 89 in the counterclockwise direction to such an extent as exceeding the predetermined value, is so designed as to be regulated by abutment of the inhalation valve 86 with the side wall of the tubular main body 1.

When the diver makes a second act of inhalation of air, the pressure within the tubular main body 1 is suppressed from being reduced as a result of an inflow of the exhaled air stored in the exhalation reservoir tank 117, so that the diaphragm 2 is not caused to be displaced. As a result, the exhaled air compensated for the air lacking in the tubular main body 1 is utilized as air for the second act of inhalation. At this time, the inhalation valve 87 is opened and the engagement lever 89 is disengaged from the first engaging claw 91*a* in association with the opening of the inhalation valve 87.

When the second act of exhalation of air is made by the driver, a part of the exhaled air is supplied to the air control chamber C1 to thereby increase the length l1 of the first contraction means B1. The increase of the length l1 indicative of an amount of contraction or expansion of the first contraction means B1 is caused to arise and allows the operating rod 90 fixed to the bottom end of the operating rod 143 to be engaged with the link 63, thereby opening the discharge control valve 61 and discharging the exhaled air through the exhalation outlet 3 into the surrounding circumstance, i.e., into the water. At the same time, the engaging claw 91*a* causes the engagement lever 89 to pivot in the clockwise direction to thereby open the inhalation valve 86.

As the diver inhales air for the third time, the pressure within the tubular main body 1 is reduced to a great extent because the discharge control valve 61 is kept opening, so that the diaphragm 2 is displaced to the left in the drawing, namely, inside the tubular main body 1, thereby allowing fresh air to be supplied to the tubular main body 1 as air for inhalation. The displacement of the diaphragm 2 inside the tubular main body 1 allows the pressure release valve 36, thereby returning the length l1 of the first contraction means B1, i.e., the air control chamber C1, to the initial state in which the length l1 is lowest. Thereafter, the operations of inhalation and exhalation are to be repeated in the same manner as described hereinabove from the operation of the first inhalation up to the operation of the third exhalation as one cycle.

Under two atmospheric pressures, the engagement lever 89 is so arranged as to be engaged with the fourth engaging claw 91*d* prior to the first act of inhalation of air by the diver, thereby allowing the exhaled air to be re-used three times as air of inhalation in substantially the same manner as described hereinabove. Likewise, under three atmospheric pressure, the engagement lever is engaged with the fifth engaging claw 91*e* prior to the first act of inhalation of air by the diver in order to allow the exhaled air to be re-employed four times as air of inhalation in substantially thesame manner as described hereinabove. Furthermore, under four atmospheric pressures, the operations are repeated in substantially the same manner by engaging the engagement lever 89 with the seventh engaging claw 91*g*, thereby allowing the exhaled air to be re-employed six times.

Although the present invention has been fully described in connection with the preferred embodiments thereof with reference to the accompanying drawings which are used only for the purpose of illustration, not limitation, those skilled in the art will readily conceive numerous changes and modifications within the framework of obviousness upon the reading of the specification herein presented of the present invention. Accordingly, such changes and modifications are, unless they depart from the spirit and scope of the present invention as delivered from the claims annexed hereto, to be construed as included therein.

What is claimed is:

1. A breathing apparatus having a fresh air supply circuit with a fresh air reservoir section in which fresh air is stored and an exhalation circulation circuit with an exhalation reservoir section in which exhaled air is stored, each of said fresh air supply circuit and said exhalation circulation circuit being connected to a mouth piece so as to be capable of re-employing the exhaled air as air for next inhalation, comprising:

an exhalation control valve for storing the exhaled air in said exhalation reservoir section by closing an exhalation outlet for discharging the exhaled air coming from the mouth piece into a surrounding circumstance;

a biasing means for biasing said exhalation control valve in a direction of closing said exhalation control valve;

a first contraction means so constructed by a flexible member as to be contractible and expandable, as to define an air control chamber inside the first contraction means, and as to expand by supplying a portion of the exhaled air from said mouth piece into the air control chamber;

a second contraction means so constructed by a flexible member as to be contractible and expandable and as to contain a predetermined amount of gas and as to contract as a pressure of said surrounding circumstance increases;

an addition means for producing the sum of an amount corresponding to expansion of said first contraction means and an amount corresponding to contraction of said second contraction means;

an association means for associating said addition means with said exhalation control valve so as to open said exhalation control valve in resistance to said biasing means when the sum produced by said addition means reaches a value which is equal to or larger than a predetermined value; and a pressure release valve for releasing a pressure within said air control chamber when the fresh air is supplied from said fresh air supply circuit to said mouth piece.

2. A breathing apparatus as claimed in claim 1, wherein:

said addition means comprises a combination of said first contraction means with said second contraction means wherein said second contraction means is so disposed as to be superposed on said first contraction means in a direction in which said first contraction means and said second contraction means are to be contracted and expanded; and said addition means gives a relative position of displacement of one end side of said combination with respect to the other end side thereof as said sum.

3. A breathing apparatus as claimed in claim 2, wherein:

said combination is arranged such that one side end of said first contraction means is a fixed end side in which said one side end thereof is fixed to a predetermined member and an other end side of said second contraction means is a free end side; and a relative position of displacement of said other end side of said second contraction means, namely, said free end side thereof, with respect to said fixed end side thereof is given as said sum.

4. A breathing apparatus as claimed in claim 3, wherein said predetermined member is a tubular main body so constructed as to be mounted to said mouth piece and as to comprise a path of respiration therewithin.

5. A breathing apparatus as claimed in claim 4, wherein:

said fresh air supply circuit and said exhalation circulation circuit are connected to said tubular main body and said tubular main body has said exhalation outlet; and said tubular main body is provided with exhalation control valve and said association mechanism.

6. A breathing apparatus as claimed in claim 5, wherein said first contraction means and said second contraction means are so disposed as to be each of a ring-sectioned shape and so to form a hollow portion which is of a concentrically and continuously circular shape and which extends in a direction in which said first contraction means and said second contraction means are contracted and expanded; and said association mechanism comprises an operating rod so disposed as to be connected to said other end side of said second contraction means, namely, said free end side thereof, and so to extend inside and through said hollow portion, and a link mechanism so disposed as to operatively associate said operating rod with said exhalation control valve.

7. A breathing apparatus as claimed in claim 3, wherein said association mechanism comprises a first member having a long hole formed therein and a second member having a pin portion formed so as to be slidably engaged with said long hole; and said association mechanism is so disposed as to allow said pin portion to be displaced through said long hole without transmitting a movement of said free end side of said combination to said exhalation control valve when said sum is smaller than said predetermined value.

8. A breathing apparatus as claimed in claim 1, wherein said flexible member constituting said second contraction means has a side wall which is of an approximately logarithmic-curved shape.

9. A breathing apparatus as claimed in claim 1, wherein:

said fresh air supply circuit comprises an inhalation control valve which is so disposed as to be opened when the pressure within said mouth piece is caused to be reduced to a great extent by inhalation of air; and said pressure release valve is operatively associated with said inhalation control valve.

10. A breathing apparatus as claimed in claim 9, wherein said inhalation control valve is operatively associated with said pressure release valve through a link mechanism.

11. A breathing apparatus as claimed in claim 10, wherein a delay mechanism is so disposed at an intermediate portion of said link mechanism as to delay opening said pressure release valve after opening of said inhalation control valve.

12. A breathing apparatus as claimed in claim 11, wherein:

said link mechanism comprises at least a first member and a second member; and said delay mechanism comprises a long hole formed on either of said first member or said second member and a pin portion formed on the member other than the member with said long hole formed and said pin portion is so disposed as to be slidably engageable with said long hole.

13. A breathing apparatus as claimed in claim 11, wherein:

said association mechanism comprises a pivotable link connected pivotably to said exhalation control valve and an operating rod connected to the free end side portion of said combination;

said operating rod is provided with an operating piece so disposed as to be engageable with said pivotable link in accordance with a stroke displacement of said operating rod; and said exhalation control valve is so disposed as to be opened as a result of engagement of said operating piece with said pivotable link, when said sum reaches a value which is equal to or larger than said predetermined value.

14. A breathing apparatus as claimed in claim 1, further comprising an expansion control mechanism for controlling an amount of expansion of said first contraction means so as to reach a predetermined value by a single act of exhalation of air.

15. A breathing apparatus as claimed in claim 14, wherein said expansion control mechanism comprises:

a rod so disposed as to be connected to said first contraction means and so to be stroke-displaced in accordance with expansion and contraction of said first contraction means;

a plurality of engaging paws formed on said rod at spaced intervals in a lengthwise direction of said rod;

an engagement lever so disposed as to be pivotably and detachably engageable with each of said engaging paws in accordance with a pivotal displacement of said engagement lever; and a reciprocating valve so disposed as to be connected to said engagement lever and as to reciprocate in response to a flow of gas caused by breathing.

16. A breathing apparatus having a fresh air supply circuit with a fresh air reservoir section in which fresh air is stored and an exhalation circulation circuit with an exhalation reservoir section in which exhaled air is stored, each of said fresh air supply circuit and said exhalation circulation circuit being connected to a mouth piece so as to be capable of re-employing the exhaled air as air for next inhalation, comprising:

a tubular main tube to which said mouth piece is mounted and to which said fresh air supply circuit and said exhalation circulation circuit are connected, and which is provided with an exhalation outlet for discharging the exhaled air into a surrounding circumstance;

an exhalation control valve for storing the exhaled air in said exhalation reservoir section by closing said exhalation outlet;

a biasing means for biasing said exhalation control valve in a direction of closing said exhalation control valve;

a first contraction means so constructed by a flexible member one end of which is fixed to said tubular main body as to be contractible and expandable, as to define an air control chamber inside the first contraction means, and as to expand by supplying a portion of the exhaled air from said mouth piece into the air control chamber;

a second contraction means so constructed by a flexible member one end of which is fixed to another end of said first contraction means as to be contractible and expandable and as to contain a predetermined amount of gas and as to contract as a pressure of said surrounding circumstance increases;

an operating rod so disposed as to be connected to another end of said second contraction means and as to be stroke-displaced in accordance with contraction or expansion of at least either one of said first contraction means or said second contraction means;

a link mechanism so disposed as to operatively associate said operating rod with said exhalation control valve so as to open said exhalation control valve in resistance to said biasing means when said operating rod is displaced in a predetermined direction in an amount which is equal to or larger than a predetermined value;

a diaphragm so disposed as to displace by a difference between a pressure within said tubular main body and a pressure of said surrounding circumstance;

an inhalation control valve so disposed as to be operatively associated with said diaphragm so as to control fresh air to said tubular main body from said fresh air supply circuit; and a pressure release valve so disposed as to be operatively associated with said diaphragm, namely, eventually said inhalation control valve, so as to release the pressure within said air control chamber into said tubular main body when said inhalation control valve is opened.

17. A breathing apparatus as claimed in claim 16, wherein said diaphragm, eventually said inhalation control valve, and said pressure release valve are connected to each other through a link mechanism with a delay mechanism, and opening of said pressure release valve is delayed after opening of said inhalation control valve.

18. A breathing apparatus as claimed in claim 16, further comprising an expansion control mechanism for controlling an amount of expansion of said first contraction means so as to reach a predetermined value by a single act of exhalation of air.

19. A breathing apparatus as claimed in claim 18, wherein said expansion control mechanism comprises:

a rod so disposed as to be connected to said first contraction means and so to be stroke-displaced in accordance with expansion and contraction of said first contraction means;

a plurality of engaging paws formed on said rod at spaced intervals in a lengthwise direction of said rod;

an engagement lever so disposed as to be pivotably and detachably engageable with each of said engaging claws in accordance with a pivotal displacement of said engagement lever; and a reciprocating valve so disposed as to be connected to said engagement lever and as to reciprocate in response of a flow of gas caused by breathing.

20. A breathing apparatus as claimed in claim 16, wherein said flexible member constituting said second contraction means has a side wall of an approximately logarithmic-curved shape.

* * * * *